United States Patent [19]

Janssen

[11] 4,259,987

[45] Apr. 7, 1981

[54] LINEAR DAMPER SYSTEM

[75] Inventor: John E. Janssen, Minnetonka, Minn.

[73] Assignee: Honeywell Inc., Minneapolis, Minn.

[21] Appl. No.: 108,190

[22] Filed: Dec. 27, 1979

[51] Int. Cl.[3] ..... F16K 19/00

[52] U.S. Cl. ..... 137/606; 98/121 A; 137/601; 236/13; 236/49

[58] Field of Search ..... 137/601, 606, 607; 98/110, 121 A; 236/13, 49

[56] References Cited

U.S. PATENT DOCUMENTS

| | | | |
|---|---|---|---|
| 392,014 | 10/1888 | Despeissis . | |
| 2,074,518 | 3/1937 | Sandberg . | |
| 2,552,982 | 5/1951 | Lambert . | |
| 3,044,387 | 7/1962 | Hinden . | |
| 3,281,113 | 10/1966 | Ahern | 137/601 X |
| 3,443,588 | 5/1969 | Banko | 137/601 |
| 3,698,429 | 10/1972 | Lowe | 137/601 |
| 4,037,783 | 7/1977 | Bradford | 236/49 |
| 4,186,564 | 2/1980 | Myers | 236/13 X |

*Primary Examiner*—Robert G. Nilson
*Attorney, Agent, or Firm*—Charles G. Mersereau

[57] ABSTRACT

The damper system for controlling the flow of a gaseous fluid in a duct member is disclosed in which the combination of parallel and opposed flow characteristics is utilized to produce a composite rate of flow which varies substantially linearly with the angle of rotation of the damper blades over the full opening range. A plurality of damper blades pivotally mounted in substantially louvered fashion is utilized in one embodiment in which alternate pairs of blades are rotated in opposite directions to produce alternate parallel and opposed passage flow characteristics. In addition to being linear, the alternate parallel and opposed flow characteristics of the adjacent blade systems of the damper provide an additive advantage in mixing flow from different streams each being provided with one of the dampers. This can be produced by combining the alternate swirling and sheet flow of the damper openings in a manner which produces intermeshing of the flow and complete mixing of the two streams. In another embodiment, the combination of parallel and opposed damper flow is produced by the use of fixed blade insert members disposed between pairs of damper blades which are operated in conventional parallel fashion.

4 Claims, 7 Drawing Figures

LINEAR DAMPER SYSTEM

BACKGROUND OF THE INVENTION

1. Field of the Invention

The present invention relates generally to the field of controlling the flow of a gaseous fluid in a duct or system of ducts and, more particularly, to a damper or mixing system utilizing dampers which have substantially linear characteristics over the modulated range from fully closed to fully opened. The dampers, when properly combined, have the ability to produce excellent mixing of streams being combined beyond the dampers.

2. Description of the Prior Art

A great deal of effort has been put forth in an attempt to produce linear control action with dampers such that the fluid flowing in a duct is proportional to the angular opening of the damper. The general approach has been to select either opposed or parallel bladed dampers according to the particular application involved and, in some cases, to further attempt to linearize its operating characteristics by reducing the size of the damper in relation to the size of the duct involved. This, of course, increases total flow resistance and decreases the efficiency of the duct system.

Other prior art dampers and linkage include one shown in a U.S. Pat. No. to Hinden, 3,044,387, issued July 17, 1962, which illustrates and describes a linkage system in which damper blades may be operated in pairs. Such a system, however, does not achieve the results contemplated by the present invention.

SUMMARY OF THE INVENTION

In accordance with the present invention, the general problem of providing a substantially linear increase in flow corresponding to an increase in damper opening angle is solved by the combination of opposed and parallel flow in a hybrid damper system. In either of two embodiments, the hybrid damper system closely approximates linearity and can be made the size of the full duct. One embodiment of the system includes one or more pairs of damper blades mounted in louver fashion and operated in pairs such that adjacent pairs are caused to pivot in unison in opposite directions upon opening or closing thereby creating an alternate parallel and opposed passage flow characteristic. In another embodiment, planar fixed blade insert members are disposed between each of the pairs of damper blades parallel to the direction of fluid flow such that when the damper blades are pivoted by a motivation means in conventional parallel blade fashion, they cooperate with the fixed blade inserts to produce alternate opposed and parallel blade fluid flow characteristics when the damper blades are in a partially opened position.

The combination of parallel and opposed flow characteristics in a single damper functions to substantially linearize the overall flow characteristics of the damper. This allows full-sized dampers to be employed in applications where formerly reduced sized dampers of either the parallel or opposed type had to be used in an attempt to linearize operating characteristics. This, of course, greatly reduces pressure losses across the damper and results in a more energy efficient system.

In addition to the benefits of linearity and reduced pressure loss, the configuration of the dampers of the present invention also contemplates improved mixing characteristics wherein it is desired to combine a plurality of streams. By properly combining the dampers of the invention, improved mixing occurs which eliminates stratification when combining streams of different temperatures wherein it is desired to produce a mixture of uniform temperature as when outside air is combined with recirculating air in a building heating or cooling system such that proper ventilation is provided. This is accomplished by utilizing a damper in each of the streams of a disposition such that the sheets of flow produced by the alternate parallel and opposed flow intersect alternately in an interdigital fashion to ensure complete mixing.

BRIEF DESCRIPTION OF THE DRAWINGS

In the drawings wherein like numerals are used to designate like parts throughout the same.

DESCRIPTION OF THE PREFERRED EMBODIMENT

Figure 1:
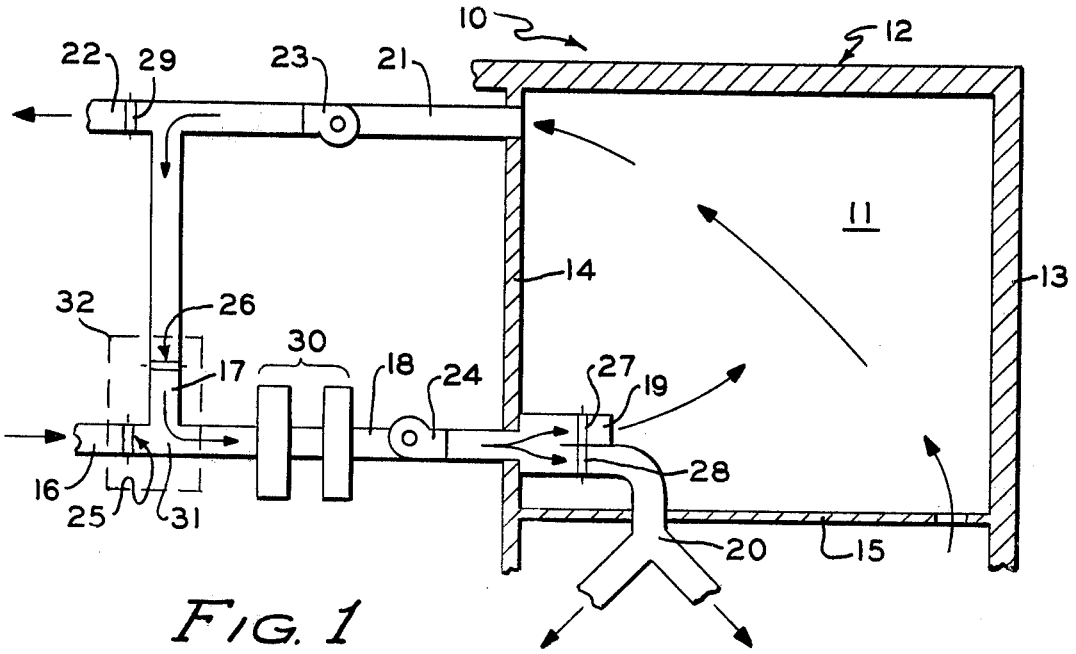
FIG. 1 is a schematic representation of a portion of a typical building duct system utilizing dampers in accordance with the invention.

Referring now to the drawings, and particularly to FIG. 1 thereof, there is shown in 10 a portion of a typical building circulation system including a representative room 11 defined by exterior walls 12 and 13 and interior walls 14 and 15. The duct system includes an outdoor air inlet 16 and recirculated air ducts 17 which are combined in a supply duct as at 18. The combined stream is then caused to enter the room 11 as through a header 18 having an opening as at 19. Likewise, additional rooms may be fed as through the additional duct work 20. Exhaust duct 21 is provided having a corresponding exhaust outlet 22.

Flow in the system is maintained by an exhaust and recirculation blower 23 and an inlet or intake blower 24. The flow is controlled by an inlet damper 25, recirculating damper 26, room dampers 27 and 28, which may be used with variable volume systems, and an exhaust damper 29. Conditioning units 30 may be provided to heat or cool the air or provide other conditioning typically associated with such systems.

In operation, intake air, the amount of which is controlled by damper 25, is mixed with an amount of recirculated air through damper 26 as at 31. This mixed stream is conditioned by the units 30 which may provide heat or cooling, humidification, or other necessary conditioning. The conditioned air then passes through the intake blower 24 through duct 18, room inlet 19, and into the internal environment as illustrated. At the same time, of course, a like amount of air must be exhausted from the internal environment through duct 21 as propelled by an exhaust blower 23. The amount of air exhausted at 22 is controlled by damper 29 such that it balances the amount of the intake air at 16 controlled by damper 25.

Figure 2:
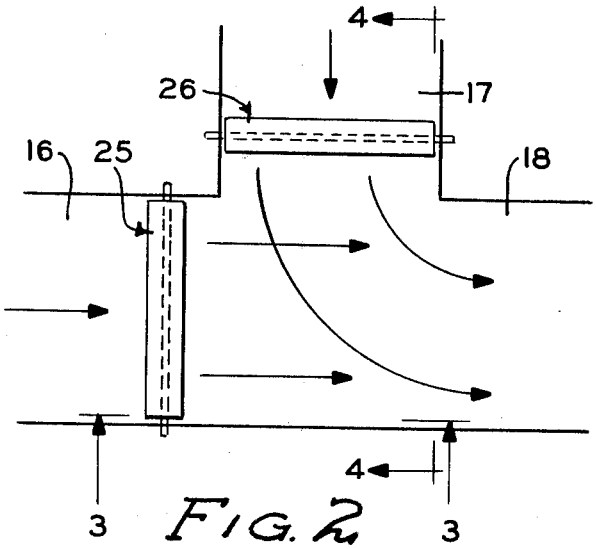
FIG. 2 is an enlarged view of the portion of FIG. 1 inside the dotted line.

FIG. 2 illustrates an enlarged view of the portion depicted at 32 of FIG. 1. This includes the air inlet 16 and inlet damper 25, recirculation damper, 26 and the mixing area 31 leading into the duct 18.

Figure 4:
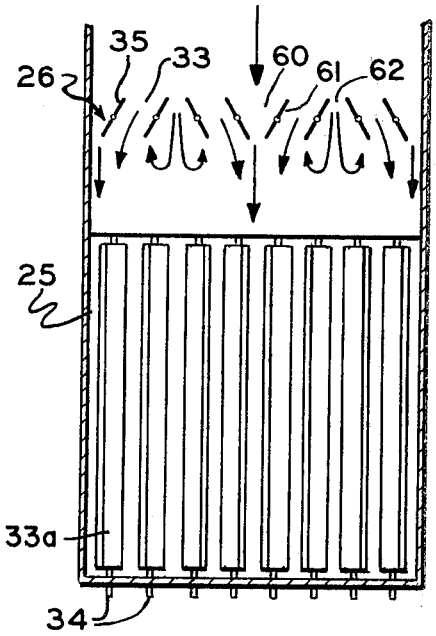
FIG. 4 is an enlarged sectional view taken substantially along line 4—4 of FIG. 2.
Figure 3:
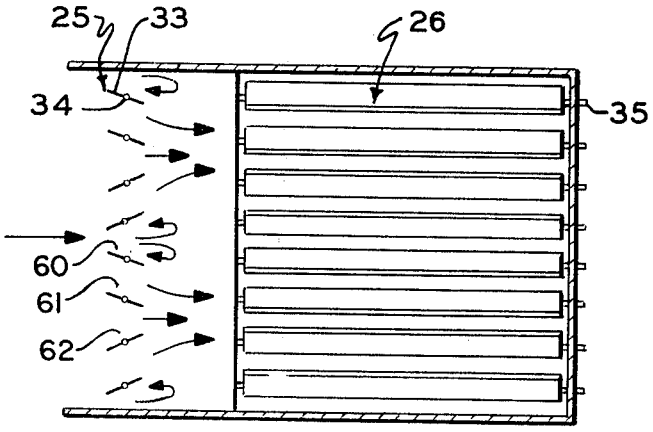
FIG. 3 is an enlarged sectional view taken substantially along line 3—3 of FIG. 2.

The actual configuration of the dampers 25 and 26 is better shown in FIGS. 3 and 4. The dampers 25 and 26 include a plurality of blade members as at 33*a* and 33 which are fixed to rotatable axes or shafts as at 34 and 35, respectively. The damper construction including the series of axially pivotal blades is similar to well known louver damper construction.

Figure 5:
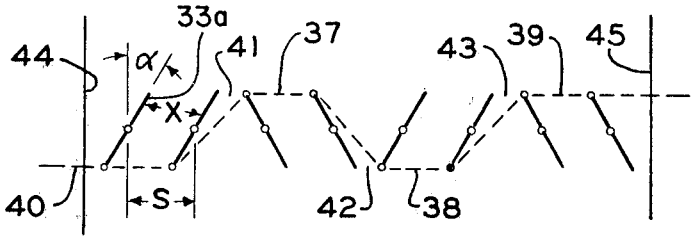
FIG. 5 is a schematic representation of one damper blade and linkage arrangement of the invention.

FIG. 5 illustrates one damper linkage arrangement to operate the blades of the dampers 25 and 26 in accordance with the present invention. It can be seen in that figure that the eight blades 33*a* are associated in pairs 36, 37, 38, and 39 linked together by a common operating linkage which may be represented by the dotted line 40. As is readily seen from FIG. 5, the pairs of blades are linked so as to rotate in alternate directions as the illustrated linkage 40 is operated to the left or to the right. In this fashion, the opening between each balde pair operates as a parallel damper configuration and the openings between the pairs of blades as at 41, 42, and 43 and those between the outer blades and the ducts 44 and 45 produce an opposed blade opening-closing characterization.

The linkage of the blades represented by the dotted line 40 can be any conventional linear damper operator utilized to open and close the damper in a well known manner such as a pneumatic cylinder or eccentric. Of course, other types of operators can be utilized inasmuch as the only limitation is the operation of the blades as oppositely rotating pairs.

Figure 6:
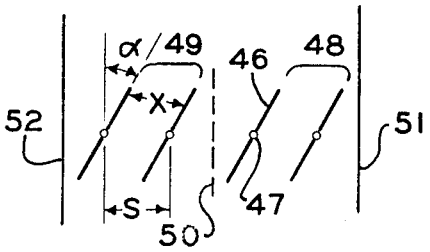
FIG. 6 is a schematic representation of an alternative damper arrangement of the invention.

FIG. 6 illustrates an alternative embodiment of the damper of the invention. In that embodiment, the damper blades as at 46 are also mounted on a series of parallel shafts as at 47 and operated in parallel pairs 48 and 49. An insert depicted by line 50 combines with duct walls 51 and 52 to provide the combined parallel and opposed damper characteristics when the pairs of blades 48 and 49 are operated in unison as is the case with a conventional straight parallel damper system. Thus, the blades may be rotated in the same direction going through the same angular displacement simultaneously in a well known fashion. Inasmuch as the linkages and activators are very well known and form no part of the present invention, explicit details may readily be supplied by one skilled in the art.

Figure 7:
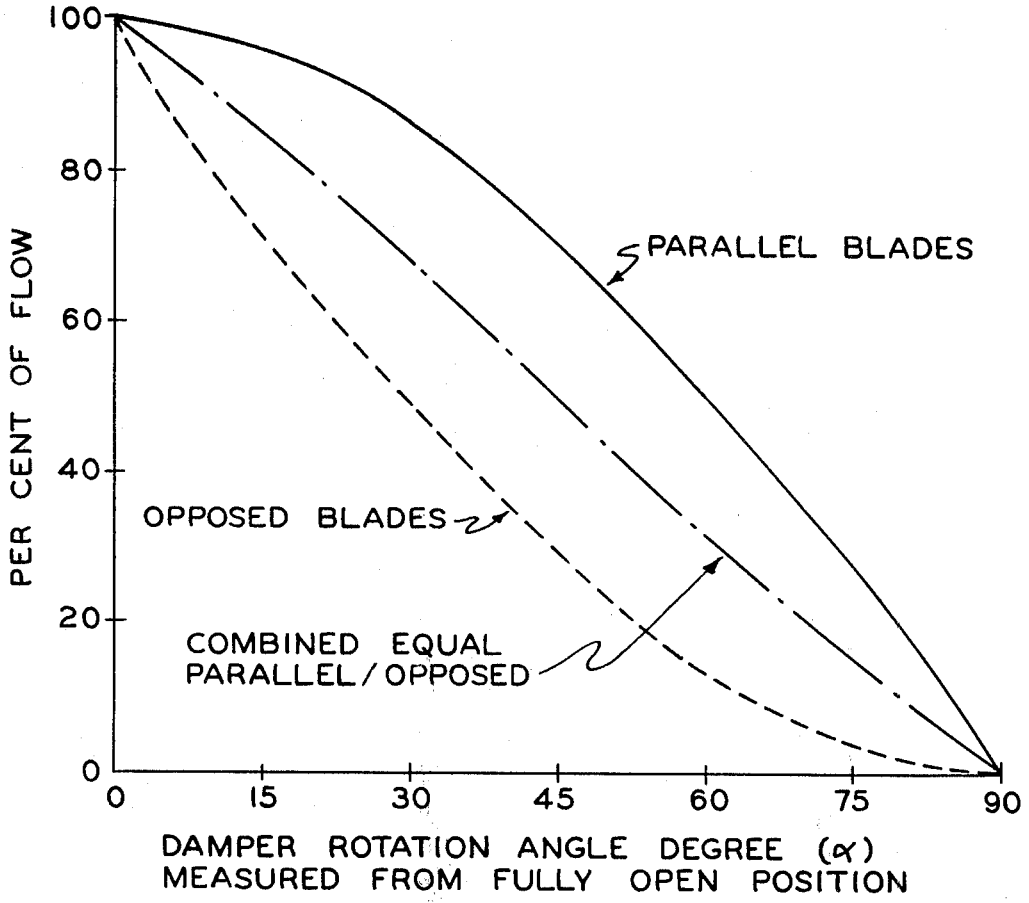
FIG. 7 is a theoretical plot of damper rotation angle versus percentage of full flow for parallel, opposed. and combination thereof in accordance with the present invention.

FIG. 7 depicts a plot of damper rotation angle versus percentage of full flow for parallel blade, opposed blade and a hybrid damper consisting of equal numbers of parallel and opposed blade configurations. It is known that flow area in the flow characteristics of dampers is a trigonometric function of the damper shaft angle. Thus, as shown in FIGS. 5 and 6, if $\alpha$=damper shaft angle measured from the full open position s=blade spacing x=flow spacing

1=blade length

The flow area through any inter-blade passage is xl and the maximum flow through open dampers is sl. Thus, the flow at any given damper angel is $$xl/sl=x/s$$

For a parallel blade arrangement $$x/s=\cos\alpha$$

and for the opposed blade arrangement by:

$$x/s=l-\sin$$

These non-linear functions are represented by the corresponding curves indicated in FIG. 7 for the range $\alpha=0°$ to $\alpha=90°$.

It can readily be seen from the curves of FIG. 7 that the parallel blade damper must close at least 30° before there is any appreciable decrease in flow. Conversely, the opposed blade damper must be open at least 30° before there is a corresponding appreciable flow through the damper.

A combination damper comprising an equal number of parallel and opposed blade arrangements accomplished either by changing the damper linkage or inserting fixed blade inserts to give a combination of equal parallel and opposed blade operation yields a composite characteristic which may be represented by:

$$x/s=0.5(\cos\alpha)+0.5\ (l-\sin\alpha)$$

This configuration produces the almost linear curve denoted in FIG. 7. From this it can be seen that the combination of parallel and opposed damper operation can achieve a great deal toward linearizing the damper angle versus flow characteristic of the damper. This, of course, results in a greatly improved overall flow control inasmuch as the damper is capable of more accurate modulation over the range from 0° to 90° or fully closed to fully opened.

It is well known that the energy required for conditioning ventilation area in a large building is frequently the major load on a heating, ventilating, or air conditioning system. This may also be the case in smaller buildings with large population densities such as schools, theaters, office buildings, and the like. Therefore, while it is important that sufficient outside air be taken into the building such that the $CO_2$ level remains low, control of the proper overall $CO_2$ level may well depend on proper mixing of the fresh intake air with the recirculated air. With present damper systems, when the outside air intake is throttled and combined with the recirculated air, stratification may well occur which will lead to improper composition of circulated air. This has been a special problem in the past in regard to large buildings with large ducting systems.

The characteristics of the dampers of the present invention can be utilized to alleviate many of the prior art stratification problems. This is illustrated by FIGS. 2–4. As noted in FIGS. 3 and 4, the combination of parallel and opposed blade configuration produces a series of divergent constant and convergent passages as illustrated at 60, 61, and 62 which produce substantially planar sheets or streams of different velocities across the width of the damper perpendicular to the blades. When two dampers are combined as illustrated in FIG. 2, i.e., if an inlet or make-up air damper is properly combined with the recirculation damper such that the plurality of substantially flow sheets eminating from the inlet damper alternately intermesh with the plurality of flow sheets eminating through the recirculation damper, the two flows combine in a manner which prevents stratification and achieves excellent mixing throughout the entire area of the duct. Thus, when the axes of the recirculation damper and the axes of the outside air damper are disposed relative to each other such that the flow of the two streams when joining intermeshes as parallel planes, excellent mixing occurs. Conventional systems cause stratification where the inlet air flow is low compared to the flow of recirculated air. The inlet air tends to be squeezed to one side of the duct and remains on that side of the duct resulting in undesirable stratification. This may lead to non-uniform distribution of outside and recirculated air in downstream branches. In accordance with the present invention, it is contemplated that a two-damper recirculation-air intake system would be configured such that proper intermeshing of the streams and thus proper mixing does occur in accordance with the present invention. This occurs when the damper blades are arranged with their axes as illustrated in FIG. 2, for example, such that the planes of the streams of flow of the two dampers are parallel rather than perpendicular or at some oblique angle. Thus, as can be seen from the above, the present invention contemplates a hybrid damper of substantially linear flow versus blade shaft angle and also contemplates a system wherein streams can be successfully mixed utilizing two of the dampers properly arranged.

The embodiments of the invention in which an exclusive property or right is claimed are defined as follows:

1. A damper system for controlling the flow of gaseous fluids through each of a plurality of separate ducts and combining the flow from said separate ducts in a manner which products substantially uniform mixing of the fluids from each of the several ducts, said system comprising:

at least a first damper means disposed in a first duct, said first damper means further comprising;

a plurality of damper blades pivotally mounted in substantially louvered fashion, motivating means associated with said damper blades and adapted to pivot all of said damper blades simultaneously such that when said blades are held in a partially opened position said flow is divided into several parallel but separated substantially planar jets of fluid having alternate parallel and opposed passage flow characteristics and wherein the composite rate of flow of the damper system versus the angle of rotation of the damper blades is substantially linear over the full operating range, a second damper means substantially similar to said first damper means disposed in a second duct which, with said first duct, converges such that the fluid flowing in said first duct s combined with that in said second duct;

wherein said first and second dampers are disposed such that the shafts of said blades of said first and said second dampers are aligned such that the two groups of jet streams intermesh upon combination.

2. A damper system for controlling the flow of a gaseous fluid in a duct having a combination of parallel and opposed blade flow characteristics, said damper system comprising:

an even number of damper blades pivotally mounted in substantially louvered fashion and associated in pairs;

substantially planar fixed blade insert members disposed between each of said pairs of damper blades and parallel to the direction of fluid flow:

motivating means associated with said damper blades and adpated to pivot all of said damper blades simultaneously such that when said blades are in a partially opened position in cooperation with said fixed blade inserts flow characteristics are produced wherein the composite rate of flow through the damper system versus the angle of rotation of the damper blades is substantially linear over the full opening range.

3. A damper system for controlling the flow of a gaseous fluid in a duct having a combination of parallel and opposed blade flow characteristics, said damper system comprising:

a plurality of damper blades pivotally mounted in substantially louvered fashion;

motivating means associated with said damper blades and adapted to pivot all of said damper blades simultaneously such that when said blades are in a partially opened position alternate parallel and opposed passage flow characteristics are produced and wherein the composite rate of flow through the damper system versus the angle of rotation of the damper blades is substantially linear over the fully opening range; and wherein said plurality of damper blades comprises an even number associated in pairs such that adjacent pairs thereof are caused to pivot in unison in opposite directions by said motivating means upon opening or closing thereby creating said alternate parallel and opposed passage flow characteristics.

4. The damper system of claim 3 including continuous linkage means connecting said plurality of damper blades such that in the open position alternate upstream and downstream extremities of alternate pairs of blades are connected thereby producing the desired angular blade displacement upon linear displacement of the continuous linkage.

* * * * *